US008381327B2

(12) United States Patent
Betzen

(10) Patent No.: US 8,381,327 B2
(45) Date of Patent: Feb. 26, 2013

(54) SHOWER CURTAIN CORNERING CLIP

(76) Inventor: Kevin Betzen, Hereford, TX (US)

( * ) Notice: Subject to any disclaimer, the term of this patent is extended or adjusted under 35 U.S.C. 154(b) by 661 days.

(21) Appl. No.: 12/629,151

(22) Filed: Dec. 2, 2009

(65) Prior Publication Data

US 2011/0126349 A1 Jun. 2, 2011

(51) Int. Cl.
*A47K 3/00* (2006.01)

(52) U.S. Cl. ..... 4/610

(58) Field of Classification Search ..... 4/609, 610
See application file for complete search history.

(56) References Cited

U.S. PATENT DOCUMENTS 4,825,481 A 5/1989 Lonberger
4,887,324 A 12/1989 Cairns
5,493,738 A 2/1996 Sanderson et al.
5,953,771 A 9/1999 VanHuss
6,094,755 A 8/2000 Matta
6,199,225 B1 3/2001 Colvin
6,510,566 B2 1/2003 Bryce
6,789,279 B2 9/2004 Yarid
6,836,909 B1 1/2005 Kirsopp
D522,298 S * 6/2006 Tascoe ..... D6/580
D635,845 S * 4/2011 Pierce ..... D8/367
2005/0236115 A1 10/2005 Ruggiero

* cited by examiner

*Primary Examiner* — Huyen Le

(57) ABSTRACT

A shower curtain clip having a curved base member with a first open end, a second closed end opposite the first end, and a curved clamping rail connected to the second closed end of the curved base member. The clamping rail clamps a shower curtain between the clamping rail and the base member in a space created between the clamping rail and the base member at the first open end, causing the curtain to curve inward, eliminating the gap between the curtain and the wall and causing water that strikes the curtain to deflect downward.

9 Claims, 6 Drawing Sheets

SHOWER CURTAIN CORNERING CLIP

CROSS REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING

Not Applicable

DESCRIPTION OF ATTACHED APPENDIX

Not Applicable

BACKGROUND OF THE INVENTION

1. Field of the Invention

This invention relates generally to shower curtain accessories and more particularly, shower curtain accessories to prevent water escapage from the shower or bath enclosure.

2. Description of Related Art

The age old problem of water escaping while one is taking a shower is one that never seems to find adequate resolution. Even a cursory exploration of the prior art reveals a surprisingly large number of granted and filed patent applications and marketed products seeking to solve this problem in a simple and cost effective manner. The prior art ranges from small, easy to install plastic adhesive clips to elaborate productions with springs, poles and brackets. Yet none of the prior art eliminates the water escapage in a manner free from additional disadvantages or in a manner such as the one described herein.

A device is needed to effectively contain water inside a shower yet be inexpensive, easy to use, small, able to accommodate any type of bathtub or shower wall surface and easy to clean. One of the simpler products are magnetic disks designed to be placed on the shower curtain and adhere to the bath tub wall. These do an adequate job of keeping the shower curtain somewhat immobilized in the interior of the bathtub, but present shortcomings such as their ineffectiveness with plastic or fiberglass shower enclosures. The magnetic disks also do not work well on the sides of the shower curtain, but rather are typically designed to adhere only along the bottom. The magnets have a tendency to "grab" onto the tub or shower wall where not intended and require shifting by the user. Last, the disks tend to bunch the shower curtain together at the bottom.

Several other fairly simplistic shower curtain products have emerged, however the vast majority require that a component of the product be affixed to the shower wall. This presents numerous disadvantages due to the necessity to properly clean the wall with alcohol first and carefully mount the component. It also means the component, if affixed with adhesive, may ultimately lose its powers of adhesion and fall off, especially when exposed to the high humidity levels of a shower environment.

Small plastic suction cups were another attempt to keep the shower curtain adhered to the wall, but present their own set of problems. The suction cups do not always work properly, especially if the wall becomes coated with any scum or soap residue. The cups themselves easily become a vehicle for soap scum and mold, requiring tedious cleaning.

A need persists for a simple, small, inexpensive, effective method and apparatus for keeping shower water from escaping onto the floor.

SUMMARY OF THE INVENTION

In accordance with the present invention, an improved method and apparatus is disclosed for keeping shower water from escaping onto the floor. It is the main object of the present invention to provide a shower curtain closure device which does not require adherence to the shower enclosure wall, although it may be adhered if the user so desires. It is another object of the present invention to provide a shower curtain closure device which curves the curtain into a corner to assist in the seal between the shower wall and the curtain, yet is small, inexpensive, and extremely easy to clean and remove. It is another objective of the present invention to provide a shower curtain clip which works on virtually any shower curtain or shower curtain liner or both, causing the shower curtain to curve inward, decreasing the gap between the shower curtain and the wall and deflecting water downward.

To achieve these and other objects of the present invention, the shower curtain clip comprises a curved base member with a first open end, a second closed end opposite the first end and a curved clamping rail that connects to the second closed end of the curved base member. The curved base member is made up of one or more rails so that space is created for the shower curtain. The clamping rail clamps the shower curtain between the clamping rail and the base member, in the space provided. The curved base member has a groove for receiving the curved clamping rail for closure.

In a preferred embodiment, the invention discloses a method for containing water inside a shower enclosure by attaching one or more curved curtain clips to the side edge of a shower curtain where the shower curtain meets the shower enclosure wall. The attachment of the clips causes the shower curtain to curve inward, causing water to deflect downward.

In an embodiment the shower curtain clip may be of a flexible material including but not limited to rubber, plastic, or other flexible yet durable and water resistant materials, allowing the clip to form odd shapes to allow for unusually shaped shower enclosures.

Other objects and advantages of the present invention will become apparent from the following descriptions, taken in connection with the accompanying figures, wherein, by way of illustration and example, an embodiment of the present invention is disclosed.

BRIEF DESCRIPTION OF THE DRAWINGS

The figures constitute a part of this specification and include exemplary embodiments to the invention, which may be embodied in various forms. It is to be understood that in some instances various aspects of the invention may be shown exaggerated or enlarged to facilitate an understanding of the invention. To enable more thorough understanding of the features and advantages of the present invention, reference is now made to the detailed description of the invention along with the accompanying figures in which.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

"Shower curtain" may indicate a shower curtain, shower curtain liner, either or both.

The disadvantages described in the prior art with regard to with regard to various shower curtain closure devices are solved by the present invention shower curtain clip that requires no mounting to the shower enclosure wall and is easy to use, easy to remove for cleaning, easy to apply, small and inexpensive.

Referring to FIGS. 1-4 a shower curtain clip in accordance with the present invention is shown comprised of a smoothly curved base member and a smoothly curved clamping rail capable of clamping on the edge of a shower curtain next to a wall and causing the shower curtain edge to curve inward.

A prototype of the described shower curtain clip has been constructed with the features of FIGS. 1-4. The clip functions as described to clamp onto the shower curtain and cause it to curve such that the natural gap between the shower curtain and the shower enclosure wall is decreased and water is deflected downward rather than escaping outward. The clip may be constructed of coated metals, plastics, rubber, or other suitable materials that can withstand water and high humidity and maintain flexibility. The base member of the clip may be constructed in a variety of fashions, for example as one solid piece or as one or more rails. The dimensions of the prototype were approximately 8" long by 1" wide, although the size of the clip may vary, depending upon its intended use. For example, larger sizes may be sold for heavier shower curtains. Although the preferred embodiment is to sell the shower curtain clip separately, it may also be incorporated into a curtain by fabrication and sold as a unit.

Figure 1A:
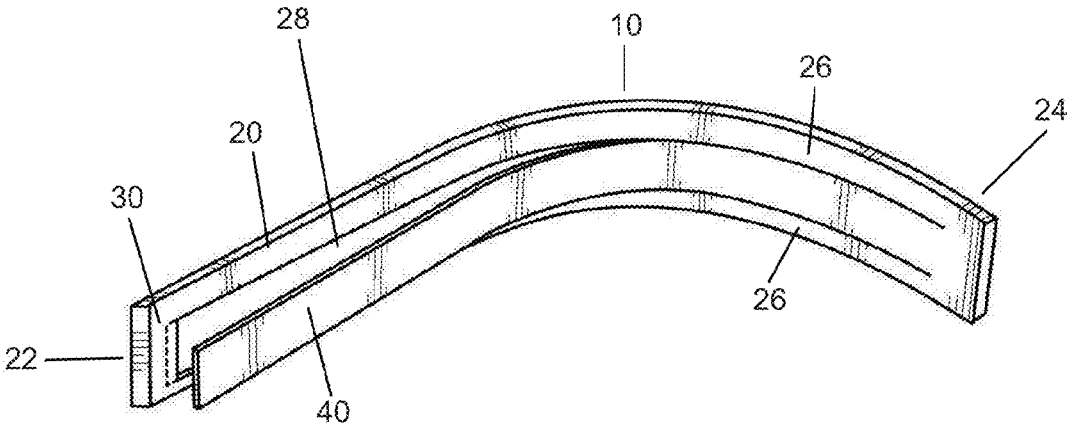
FIG. 1*a* is a perspective inside view of the preferred embodiment of the present invention.

Turning to the drawings, as illustrated in FIG. 1*a*, the shower curtain clip 10 is gently curved and comprises a base member 20 with a first open end 22 and a second closed end 24 opposite the first end 22. The base member 20 can comprise one or more rails 26, so that there is a space 28 created between the rails 26 to more easily accommodate the shower curtain when the clip 10 is clamped in place. The base member 20 has a groove 30 for receiving the curved clamping rail 40 to enable closure. In this example, the curved clamping rail 40 is shown in its open position.

Figure 1B:
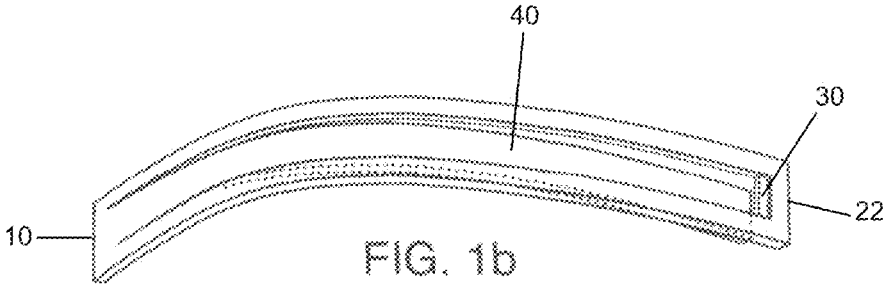
FIGS. 1*b* and 1*c* are front views of an exterior view of the preferred embodiment, showing the closure.
Figure 1C:
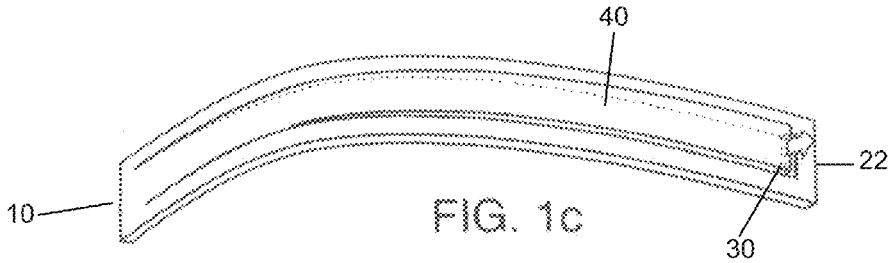

FIGS. 1*b* and 1*c* exemplify the design and closure of the clip 10 in its preferred embodiment. FIG. 1*b*, by the dotted lines, shows the movement of the clamping rail 40 as it is raised up to fill in the space left between the two base member rails 26 and then pushed back slightly to nestle into the groove 30 in the receiving open end 22 of the base member 20, resulting in snug closure. FIG. 1*c* shows the clip 10 in its closed mode. The dotted lines reflect the movement of the clamping rail as it is moved into closure.

Figure 1D:
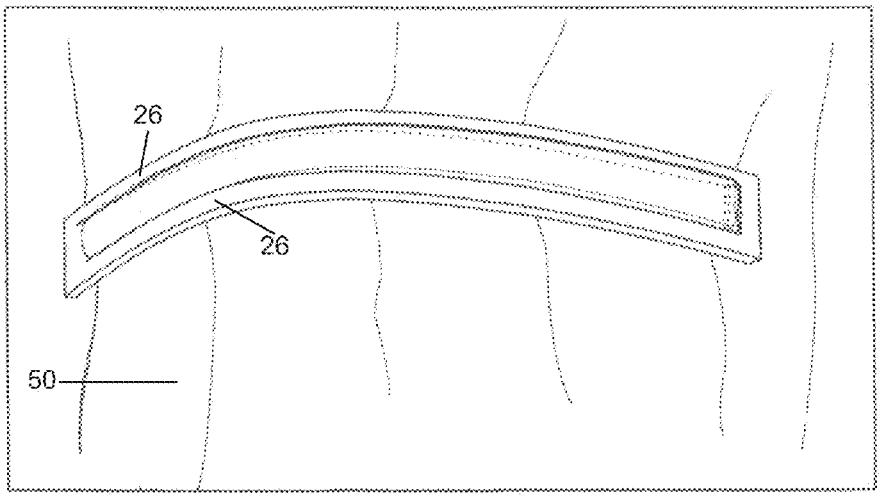
FIG. 1*d* is close up exterior view of the preferred embodiment of the present invention, in use on the shower curtain.
Figure 2:
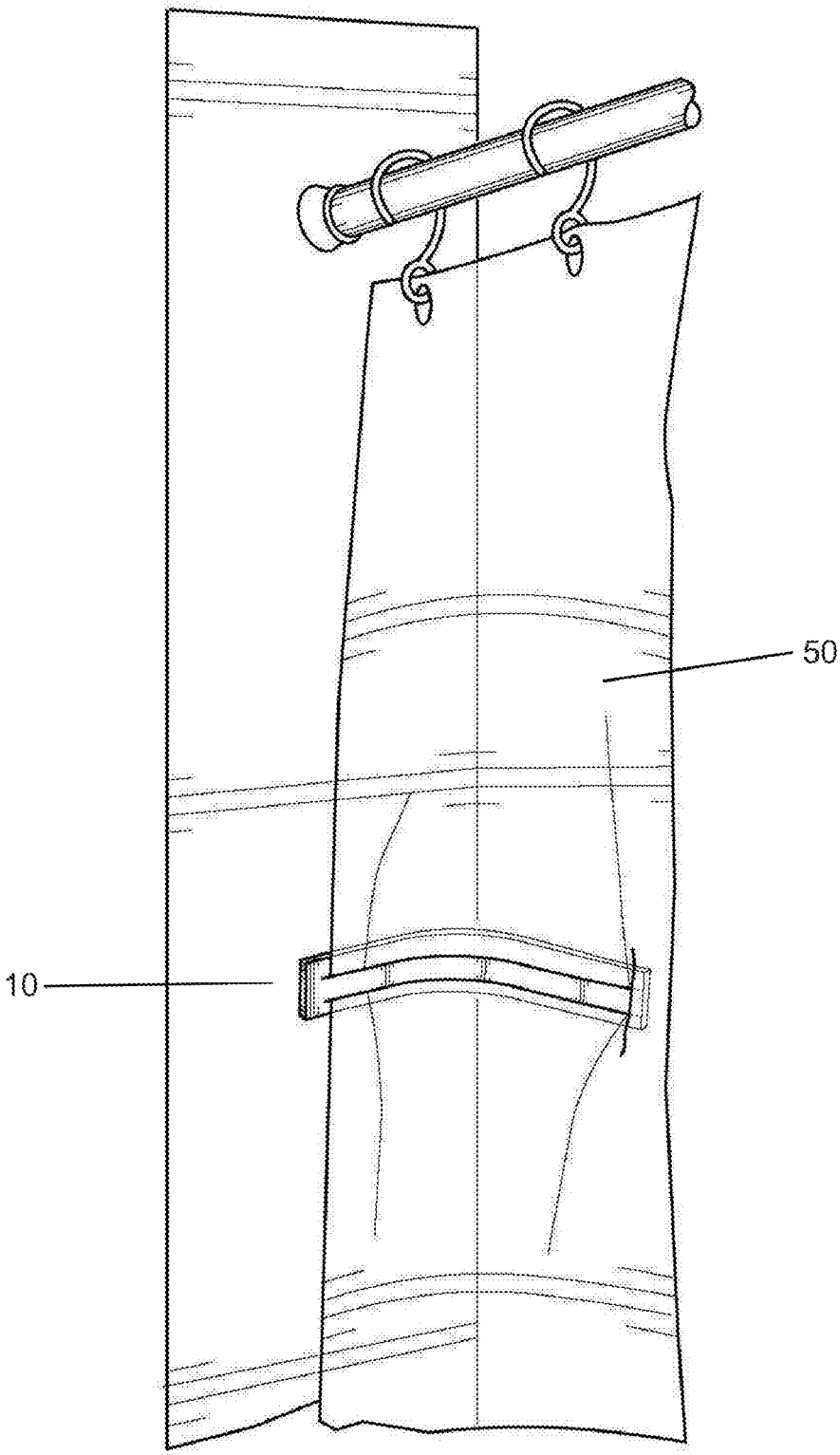
FIG. 2 is a perspective inside view of the preferred embodiment of the present invention, in use on the shower curtain.

As FIG. 1*d* illustrates in this exterior view of the shower curtain clip in place on a shower curtain, the space left between the two base member rails 26 easily accommodates the shower curtain 50 when the clip 10 is closed. FIG. 2 depicts an interior view of the clip 10 in place on the shower curtain 50, and illustrates the curved shape that the shower curtain 50 exhibits once the clip is applied, thus decreasing the gap between the shower curtain and the wall and further causing water that strikes the curtain to deflect downward.

Figure 3A:
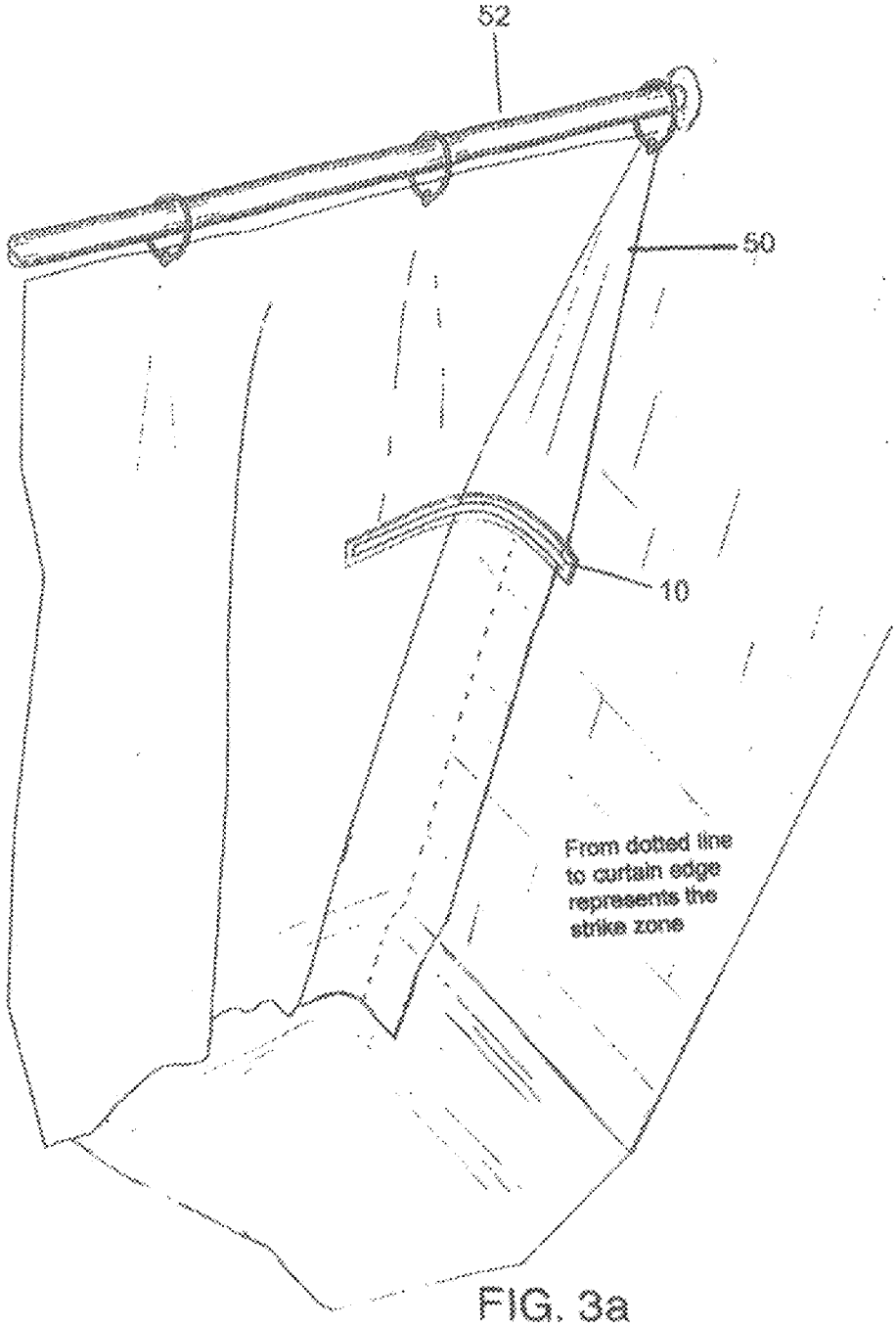
FIG. 3*a* is a perspective view of the preferred embodiment in use.
Figure 3B:
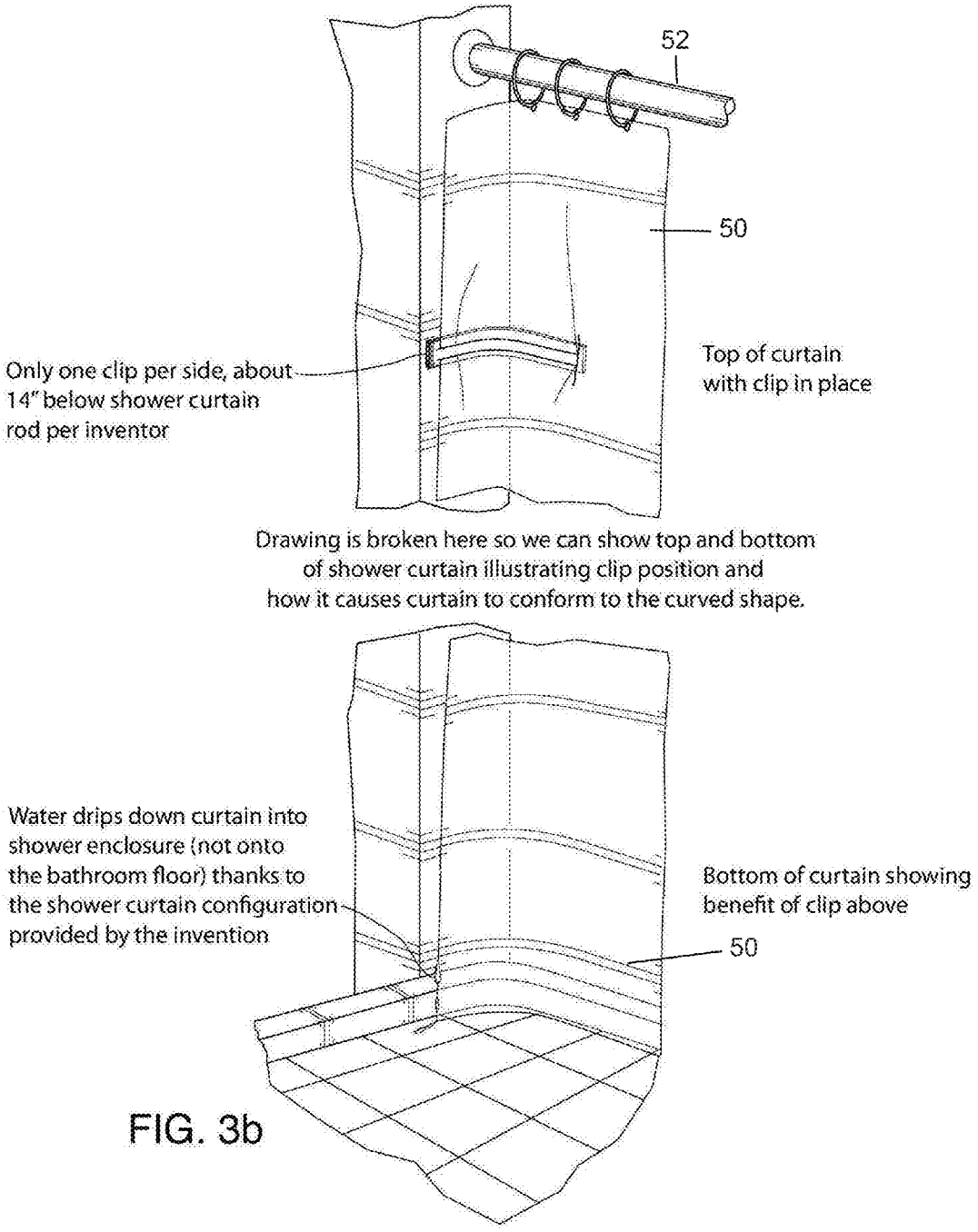
FIG. 3*b* is a detailed view of the preferred embodiment in use.
Figure 4:
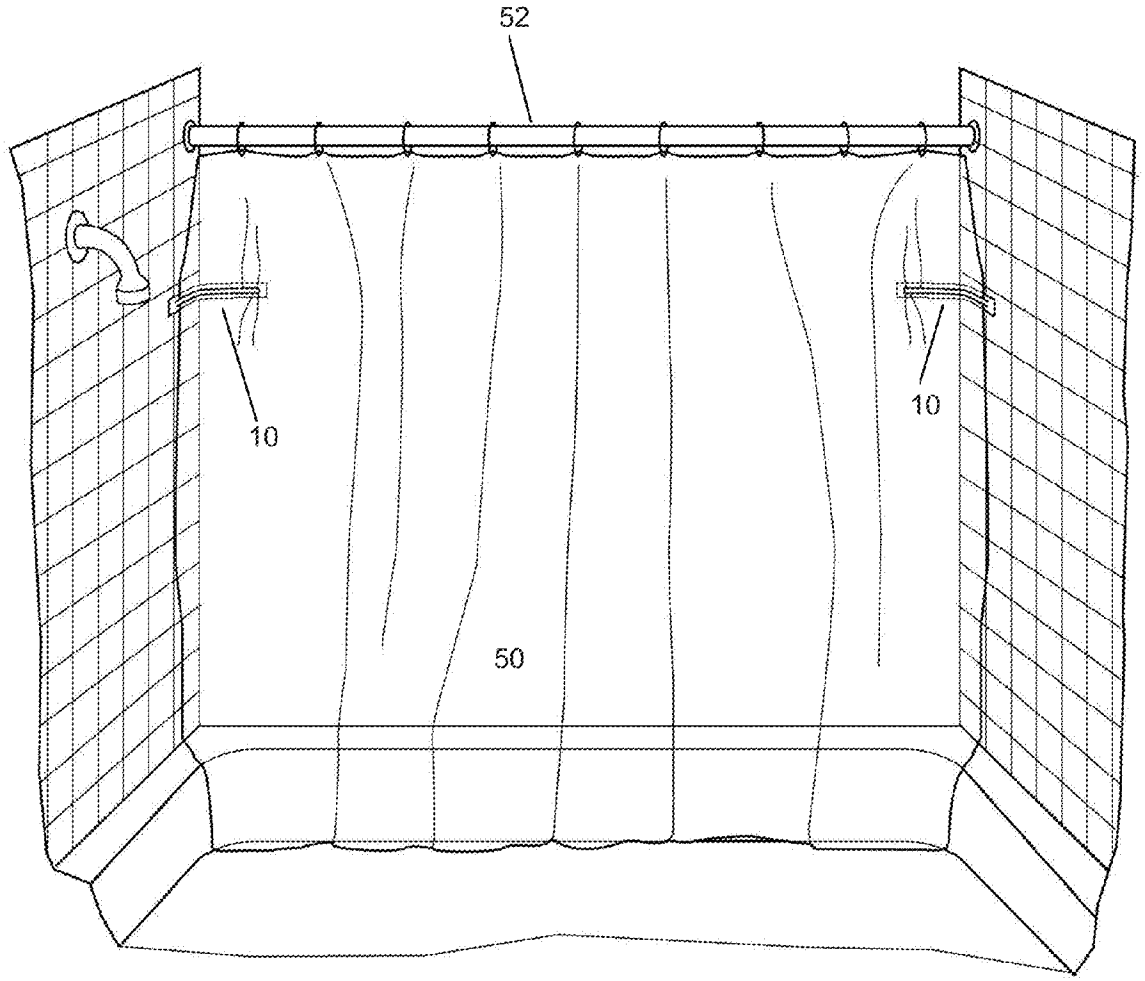
FIG. 4 is a perspective view of the preferred embodiment in use.

FIGS. 3 and 4 further exhibit the clip 10 in use. FIG. 3*a* offers a perspective view of the shower cornering curtain clip 10 in use on the shower curtain 50. The dotted lines exemplify what the inventor refers to as the "strike zone" 60.

The clip 10 creates and controls the strike zone 60. The strike zone 60 is an area of the shower curtain 50 approximately two inches wide that runs along the edge of the curtain 50 from the clip 10 to the bottom of the shower curtain 50. The strike zone 60 has a two purpose function. The first is that the clip 10 forces the curtain 50 to run in a strike zone 60 parallel to the wall so that when water strikes this area the curtain is pushed toward the wall assisting in closing. Second, when this strike zone 60 (approximately a two inch strip) becomes wet, it readily clings to the wall because of its parallel nature, creating a seal.

Once the clip 10 is applied to the curtain 50, the curtain 50 curves inward and what was formerly a gap between the side edge of the shower curtain 50 and the wall now is eliminated as the shower curtain 50 curves in along the wall. As the water begins hitting and dripping down the strike zone 60, the wet curtain 50 begins to lay even more flatly against the wall, sealing the gap entirely.

FIG. 3*b* continues to illustrate the curve that is created in the shower curtain and the water dripping down the curtain, rather than escaping out between the wall and the shower curtain.

FIG. 4 exhibits how, in the preferred embodiment, one clip 10 is used on each side end of the shower curtain 50 and each clip 10 is positioned approximately fourteen inches below the shower curtain rod 52. This placement achieves the desired curvature all the way down the shower curtain 50, causing the water to deflect downward as it hits the shower curtain 50. The deflection of the water causes the water to go down to the bottom of the shower or bath enclosure rather than escaping out in the gap that, prior to placement of the clip 10, typically exists between the shower curtain and the enclosure wall.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It is to be understood that the embodiments disclosed herein are shown for illustrative purposes and are not intended to be construed as limitations of the disclosed method and system. Those skilled in the art will recognize or be able to ascertain in the course of routine experimentation, that variations and equivalents of the embodiments may be undertaken without departing from the scope of the invention.

Certain terms are used throughout the description to refer to particular method components. As one skilled in the art will appreciate, design and manufacturing companies may refer to a component by different names. This document does not intend to distinguish between components that differ in name but not function.

The terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other intermediate devices and connections. Moreover, the term "method" means "one or more components" combined together. Thus, a method can comprise an "entire method" or "sub methods" within the method.

The use of the word "a" or "an" when used in conjunction with the word "comprising" may mean "one", or may also mean "one or more." The use of the term "or" in the claims is used to mean "and/or" unless explicitly indicated to refer to alternatives only or the alternatives are mutually exclusive, although the disclosures supports a definition that refers to only alternatives and "and/or."

The methods and systems disclosed and claimed herein can be made and executed without undue experimentation based on the level of disclosure presented. While the methods and systems have been described in terms of their preferred embodiments, it will be apparent to those skilled in the art that they are not limited to the exact steps described and may vary from such description without departing from the scope and spirit of the invention. The substitutes and modifications employed by one skilled in the art are deemed to fall within the scope of the invention.

What is claimed is:

1. A shower curtain clip for clamping onto a side edge of a shower curtain to cause it to curve inwardly, the clip comprising:

a curved base member having a first open end and a second closed end opposite the first end, the curved base member further having a receiving groove at the first open end;

a curved clamping rail connected to the second closed end of the curved base member, the opposing end of the rail being received into the groove of the curved base member when the clip is clamped, wherein the clamping rail clamps a shower curtain between the clamping rail and the base member in a space created between the clamping rail and the base member.

2. The shower curtain clip of claim 1 wherein the curved base member is comprised of two rails with a space between the rails for accommodating the shower curtain when the clip is clamped.

3. The shower curtain clip of claim 1 wherein the curved base member is comprised of one rail.

4. A method for containing water inside a shower enclosure, the method comprising:

attaching one or more curved curtain clips to the side edge of a shower curtain where the shower curtain meets a wall of the shower enclosure in order to curve the shower curtain inward, reducing the gap between the curtain and the wall and causing water that strikes the curtain to deflect downward, the curtain clips comprising a curved base member having a first open end and a second closed end opposite the first end and further having a curved clamping rail fixedly connected to the second closed end of the curved base member, wherein the clamping rail clamps a shower curtain between the clamping rail and the base member in a space created between the clamping rail and the base member, the clip clamping by sliding the free end of the clamping rail into a receiving groove at the first open end of the base member.

5. The method of claim 4, wherein the curved base member comprises two rails with a space between the rails for accommodating the shower curtain when the clip is clamped.

6. A clip to cause a side edge of a shower curtain to curve inward, the clip comprising:

a base member having a first open end and a second closed end opposite the first end, the base member further comprised of two rails, the rails having space between them to accommodate the shower curtain when the clip is clamped;

a clamping rail connected to the second closed end of the base member, wherein the clamping rail clamps a shower curtain between the clamping rail and the base member in a space created between the clamping rail and the base member.

7. The clip of claim 6, wherein the base member comprises a groove for receiving the clamping rail.

8. The clip of claim 6 wherein the base member is curved.

9. The clip of claim 6 wherein the clamping rail is curved.

* * * * *